US007927163B2

(12) United States Patent
Zeyger

(10) Patent No.: US 7,927,163 B2
(45) Date of Patent: Apr. 19, 2011

(54) RECREATIONAL FLOTATION DEVICE

(76) Inventor: Eugene Zeyger, Medfield, MA (US)

( * ) Notice: Subject to any disclaimer, the term of this patent is extended or adjusted under 35 U.S.C. 154(b) by 0 days.

(21) Appl. No.: 12/804,926

(22) Filed: Aug. 2, 2010

(65) Prior Publication Data

US 2010/0297900 A1 Nov. 25, 2010

Related U.S. Application Data

(63) Continuation-in-part of application No. 11/724,163, filed on Mar. 15, 2007, now abandoned.

(60) Provisional application No. 60/833,406, filed on Jul. 27, 2006.

(51) Int. Cl.
*A63B 31/00* (2006.01)

(52) U.S. Cl. ..... 441/129

(58) Field of Classification Search ..... 441/67, 441/129; 114/346; 472/13, 128, 129
See application file for complete search history.

(56) References Cited

U.S. PATENT DOCUMENTS 2,938,727 A * 5/1960 Nosak ..... 482/78
3,664,290 A * 5/1972 Finn ..... 441/66

FOREIGN PATENT DOCUMENTS

FR 2581960 A1 * 11/1986

* cited by examiner

*Primary Examiner* — Ed Swinehart
(74) *Attorney, Agent, or Firm* — Lawrence G. Fridman

(57) ABSTRACT

A flotation recreational device consists of a buoyant vessel having a semispherical exterior surface and a sufficient internal area adapted to accommodate an operator. The vessel is configured to have a geometrical center which is a metacenter of a spherical buoyant body serving as a base of the partially-spherical exterior surface. The center of sphere is spaced from and located above the center of gravity of the operator, so the radius of sphere is greater than the height of said center of gravity. The stability of a vessel-operator system is determined by a stability of a distance between the metacenter and the center of gravity of the operator. The vessel can be in the form of a circular shell, an elliptical shell, or a barrel.

18 Claims, 6 Drawing Sheets

RECREATIONAL FLOTATION DEVICE

RELATED APPLICATIONS

This application is a continuation-in-part application of Ser. No. 11/724,163 filed MAR. 15, 2007 now abandoned which claims priority of the Provisional Patent Application No. 60/833,406, filed by Eugene Zeyger ON JUL. 27, 2006 which application is hereby incorporated in its entirety by reference.

FIELD OF TILE INVENTION

The invention relates to recreational devices in general, and in particular it relates to flotation devices adapted for recreational play on water.

BACKGROUND OF THE INVENTION

Recreational devices for play on water, such as fashion floats, boards, noodles, etc. are known in the prior art. It should be noted however, that many of these devices suffer from various drawbacks. For example, a variety of the prior art devices are adapted for operation by a user who is in sitting or laying position. In view of the lack of stability, it is often inconvenient or even dangerous to operate such devices by an operator in an upright position. One of the reasons is that in many of the prior art recreational flotation devices the metacenter or the center of stability is located below the center of gravity of the operators body.

In view of the above, it has been long felt an unsolved need to provide a flotation recreational device which is stable practically at any position of an operator including his or her upright position, so as to enables the operator to stand, run, creep, etc while using the device. Furthermore, it has been a need for a recreational flotation device which is stable enough for use on open water and in swimming pools of practically any size.

SUMMARY OF THE INVENTION

One aspect of the invention provides a flotation recreational device adapted to be propelled on a surface of water by movement of an operator situated within the device. The device comprises a buoyant vessel having a partially-spherical exterior surface and sufficient internal space to accommodate an operator. The vessel being configured so as to have a geometrical center, which is a metacenter for a spherical, buoyant body to be spaced from and located above the center of gravity of an operator. In this manner the radius of sphere "R" is greater than the height of center of gravity "H". Stability of a vessel-operator system is determined by a stability of a distance between the center of buoyancy and the center of gravity of the operator.

As to another aspect of the invention, the open-ended buoyant vessel is in a form of a circular shell with exterior surface being formed as one base spherical segment and provided with a substantially circular rim formed at the exterior periphery of the shell. The buoyant vessel can also be in the form of an elliptical sphere with a rim provided along the elliptical edge. The buoyant vessel can be also be in the form of a barrel formed as a part of a sphere with rims provided at each side of the barrel.

As to a further aspect of the invention, a deformable bellowed structure extends outwardly from the rim of the shell so that the spherical exterior surface of the shell, the rim and the bellowed structure form an operational recess therebetween.

In a tilted position of the shell, the operational recess is adapted for close engagement with the wall of a pool receiving the vessel, so as to prevent interference of the body of the operator with the inner portion of the device.

In accordance with present invention, the flotation devices are made as a part of spherical or semispherical body, such as for example in the form of circular or elliptical semispherical shells, or in the shape of a semispherical barrel. For any shape of vessel the radius of the sphere is greater than the height of the center of gravity of the operator positioned within the interior of the vessel.

When a typical operator is a child, the center of sphere is typically positioned above the operator's center of gravity. However, in order to accommodate an adult operator having a body with relatively high elevation of the gravity center (a central or low area of the stomach) it will be necessary to increase the radius of the spherical member or to use the spherical member having greater diameter.

BRIEF DESCRIPTION OF THE DRAWINGS

Referring now to the drawings which are provided to illustrate and not to limit the invention, wherein.

DETAILED DESCRIPTION OF THE INVENTION

Figure 15:
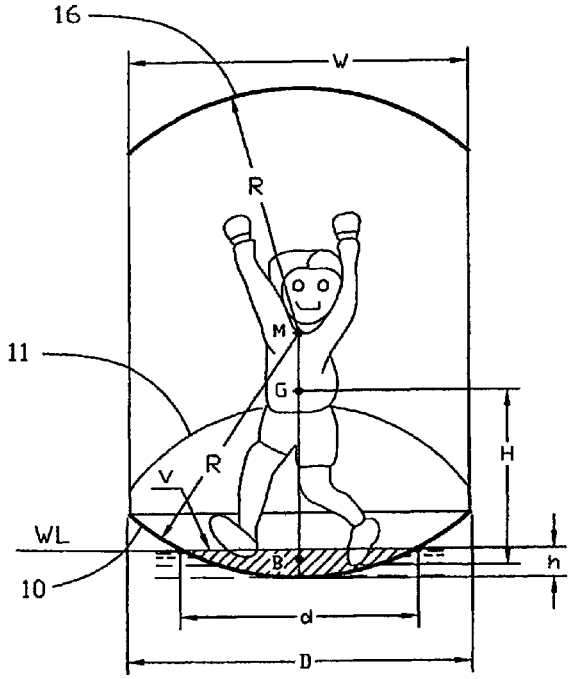
FIG. 15 is a diagram illustrating essential characteristics of the invention.
Figure 16:
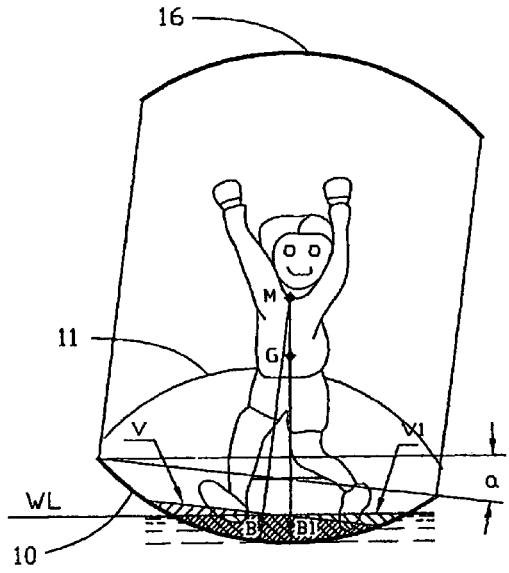
FIG. 16 is another diagram illustrating essential characteristics of the invention.

Referring now to FIGS. 15 and 16 illustrating essential characteristics of the invention and showing the flotation device disposed on a surface of water contained within a basin or pool. Various forms of the flotation device are developed based on a body having a spherical configuration. For example, the device can be configured as a circular shell 10 formed as a spherical segment, or it can be shaped as an elliptical shell 11, or it can be shaped as a barrel 16, etc. The geometrical center of the base spherical body with the radius "R" extending therefrom coincides with a metacenter "M" or a center of stability of the body. For the purposes of the invention it is assumed that the center of gravity "G" of the operator using the vessel is located at a low area of his or her stomach. The gravity distance or gravity elevation "H" is the distance between the gravity center "G" of the operator and the area where his or her legs engage the inner concaved wall of the vessel. According to one aspect of the invention, the radius "R" of the partially spherical body is greater than the gravity distance or elevation "H".

As illustrated in FIGS. 15 and 16, in one embodiment the vessel, which can be in the form of the shells 10 and 11 or barrel 16 for example, is used in combination with a substantially round pool 20 (See FIGS. 1-7) having an internal diameter "d". The depth of the pool is greater than the height "h" of a portion of the vessel submerged in to the water. The vessel of the invention is stable practically at any position of the operator on the curved inner surface thereof. The metacenter "M" of the vessel (located at the geometrical center of the spherical member) is spaced from or located above the center of gravity "G" of the operator. The stability of the vessel-operator system is determined by the stability of the distance "MG" which is the distance between the metacenter "M" and the center of gravity "G" of the operator. This arrangement is analogous to a pendulum, so that the body is suspended from a fixed point to swing freely to and from this position under the action of gravity. In such instance, the operator 22 practically can not overturn the vessel. During the movement of the operator along the inner periphery of the vessel, it typically moves in the direction opposite to the direction of the operator's movement.

Another aspect of the invention addresses a floating interface between the inner area of the pool and the exterior of the floating vessel which is based on correlation between the internal diameter of the pool "d" and the exterior of the vessel. To control the flotational motion, the inner periphery or diameter of the pool "d" (at least at the upper region thereof) corresponds to the upper water line "WL" of the portions of the vessel "V" (with center of buoyancy "B" at horizontal vessel position) or "V1" (with center of buoyancy "B1" at tilted vessel position) submerged into a water contained in the pool. When an operator having a specific weight is positioned within the interior of the vessel, it submerges and a specific load water line "WL" is delineated at the exterior of the vessel. In the embodiment where the vessel has a semi-spherical exterior, the load water line "WL" can be in the form of circumference corresponding to the level of displayed water supporting the vessel. As best illustrated in at least FIGS. 1-7, to facilitate play by the operator, the components of the arrangement are selected to have a gap 17 between the inner periphery of the pool and the circumferential load water line of the vessel. This gap 17 facilitates controlled flotational motion of the vessel within the inner space of the pool. However, as illustrated in FIGS. 15 and 16, the invention is also operable where such gap is minimal or without the gap at all. In this instance, the inner diameter of the pool "d" defined by its semi-flexible walls directly corresponds to the upper load water line "WL" of the portion of the vessel submerged into the water. In this instance, a water layer between an outer surface of the shell and inner walls of the pool serves as a lubricant facilitating motion of the shell. This floatation is further controlled by the operational space 15 (defined by the exterior of the vessel, the rim, etc.) adapted for close co-operation and engagement with the walls of the pool.

The upper portion of the vessel positioned above the load water line defines an elevational height of the vessel which controls the space between the upper rim of the vessel and surface of wall in the pool. A tilting angle or allowable angle of inclination of the vessel within the pool, is a function of the space. The longer the elevational height and the respective space, the greater the tilting angle is allowed in operation of the invention.

The tilting angle "$\alpha$" is a function of how far the exterior surface of the vessel extends over the top surface of the pool. The extent of the walls and formation of the rim at their outer end establish limits of a tilting angle, thus preventing water running over the edge of the vessel.

As to another embodiment of the invention, a shell is provided within a plurality of water lines on the exterior of the vessel to identify the weight of an operator/child allowed to use the device at a specific diameter of the pool. The purpose of these multiple load water lines is to ensure that the vessel has a sufficient freeboard space (the height from the water line to the upper rim or periphery of the shell) by an operator having specific weight and thus has sufficient reserved buoyancy which is a function enclosed volume created by the area between the water line and the upper periphery of the vessel.

Figure 1:
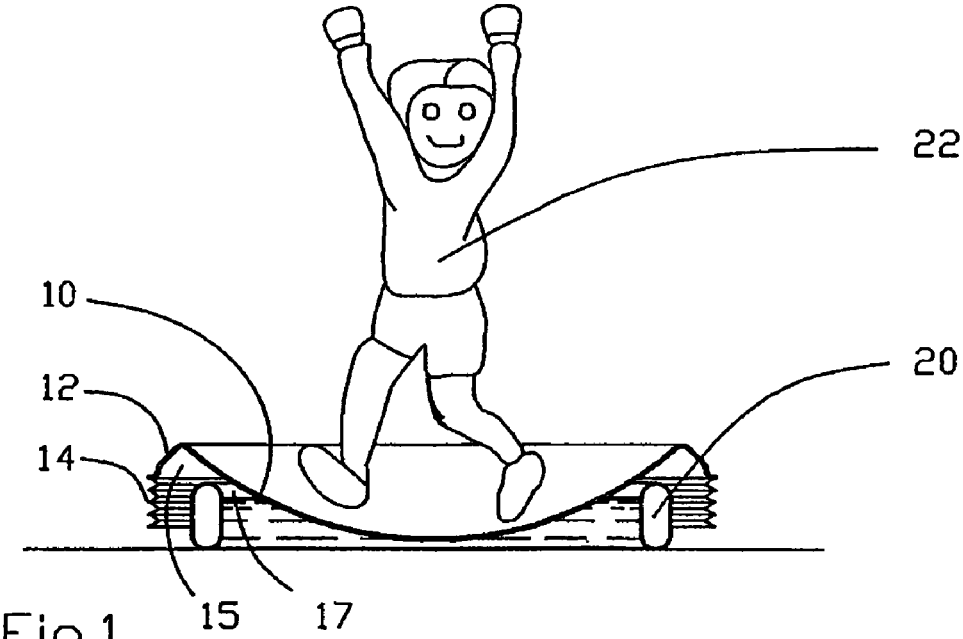
FIG. 1 is an elevational view showing the flotation device of the invention in the form of a circular shell in one position thereof.
Figure 2:
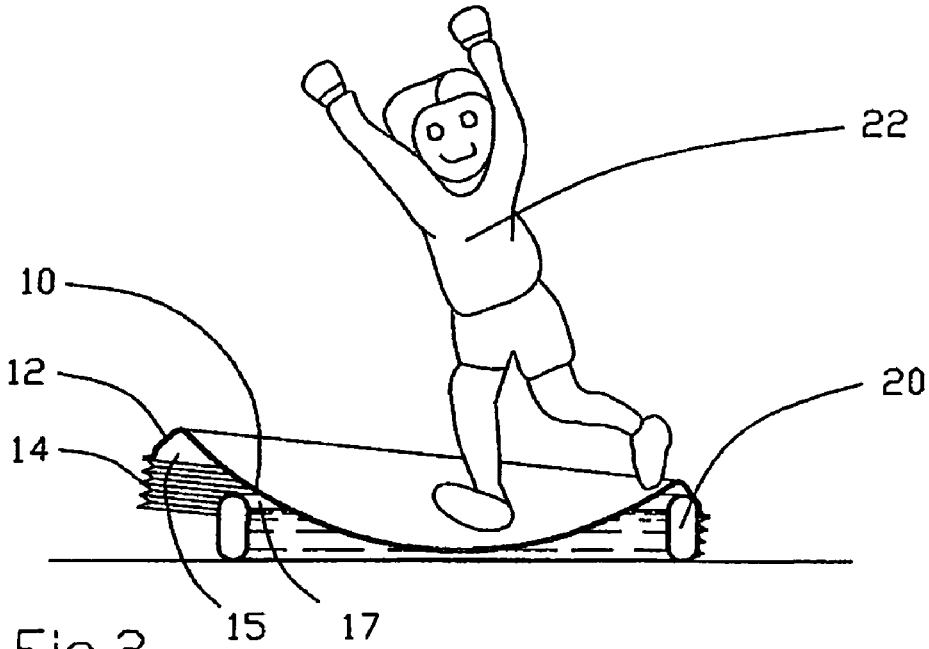
FIG. 2 is an elevational view showing another position thereof.

Referring now to FIGS. 1 and 2 illustrating one embodiment of the invention with the recreational flotation device 10 being in the form a circular shell with walls developed as a single based spherical segment having concavo-convex configuration. This segment can be formed by cutting a hollow spherical body by a plane which can be substantially parallel to horizontal. The convex exterior wall is adapted to contact a surface of water, whereas the concaved inner wall supports the operator. This design also allows the vessel to spin or turn relative to a vertical axis and to permit the operator to move the shell over the water surface. A rim 12 is provided at the exterior periphery of the shell. A deformable bellowed structure 14 extends outwardly from the rim 12. One end of the deformable structure 14 is connected to the rim 12, while the other end thereof is free. The deformable bellow structure 14 is a safety feature and is provided to prevent accidental undesirable interference of the body of the operator with the shell-pool interface. It is illustrated in FIGS. 1 and 2 that the convex exterior wall of the shell 10, the rim 12 and the bellow structure 14 form an operational recess 15. In the tilted position of the shell 10 (see FIG. 2), the operational recess 15 is adapted for close engagement with the exterior walls of the pool 20, so as to prevent any interference of the body of the operator with the inner portion of the device. Upon circular movement of the operator along the outer periphery of the shell, the shell floating in the pool of water moves in the direction opposite to the direction of operator's movement.

Figure 3:
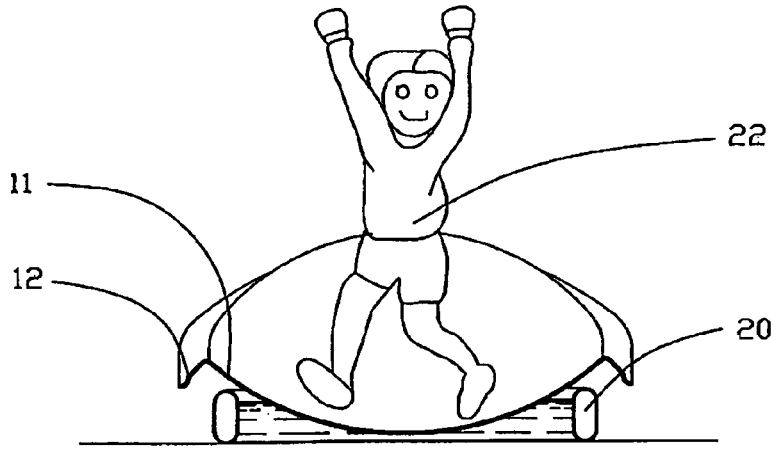
FIG. 3 is an elevational view showing the flotation device of the invention in the form of an elliptical shell in one position thereof.
Figure 4:
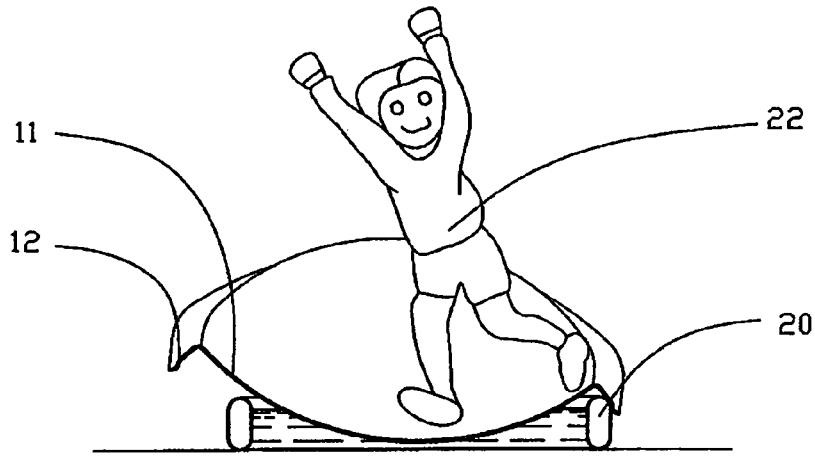
FIG. 4 is an elevational view showing another position thereof.
Figure 5:
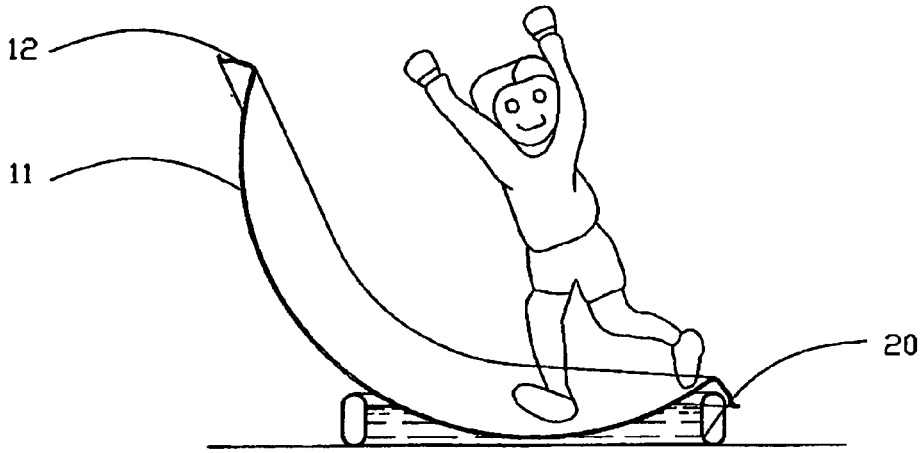
FIG. 5 is an elevational view showing a further position thereof.

Referring now to FIGS. 3-5 illustrating another embodiment of the invention where a recreational flotation device 11 is in the form of an elliptical shell with walls having concavo-convex configuration. The walls of the shell 11 are formed by cutting a hollow spherical body along an elliptical line traced on the spherical surface. The width "W" of the elliptical shell 11 (see FIG. 15) is similar to the diameter "D" of the circular shell 10 discussed above. However, the length of the elliptical shell is determined by a predetermined tilting position of the shell 11 (see FIG. 5). The convex exterior wall is adapted to contact a surface of water, whereas the concaved inner wall supports the operator. A rim 12 is provided at the exterior periphery of the shell.

Figure 6:
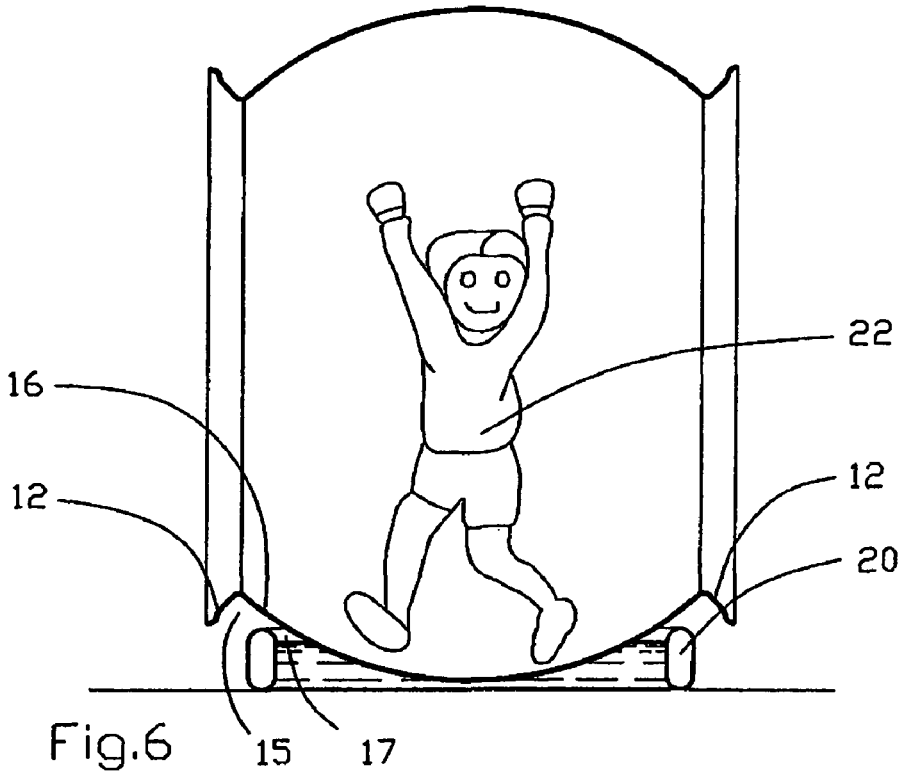
FIG. 6 is an elevational view showing the flotation device of the invention in the form of a barrel in one position thereof.
Figure 7:
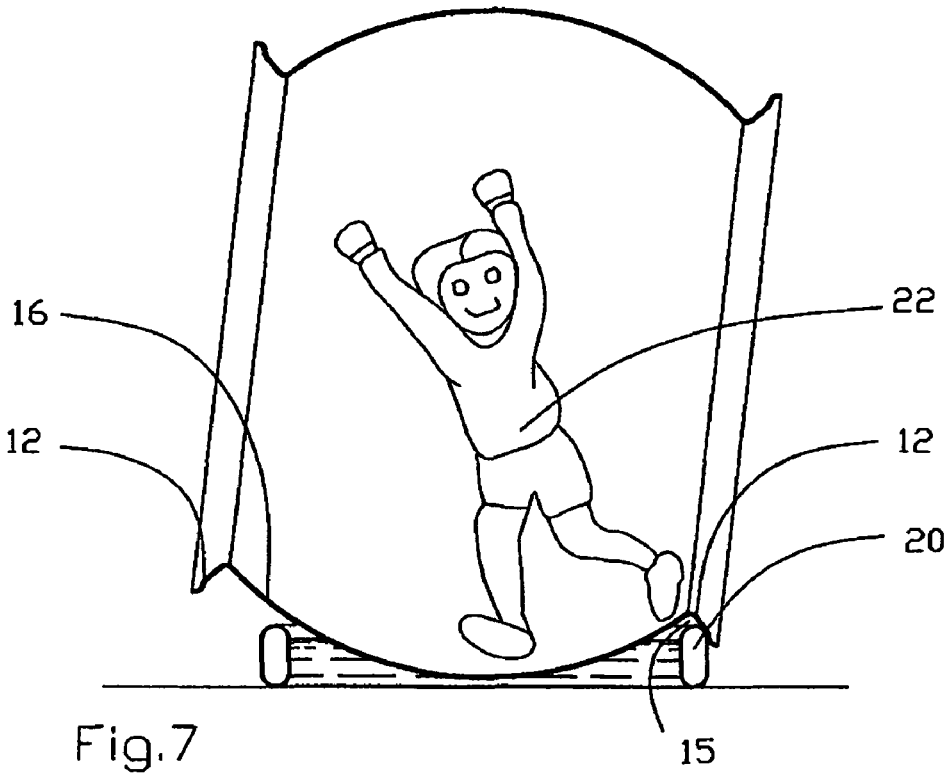
FIG. 7 is an elevational view showing another position thereof.

We are referring now to FIGS. 6 and 7 showing another embodiment of the invention where a barrel-type semi-spherical vessel 16 is supported on a surface of water. The internal dimensions of the vessel are such that an operator 22, such as a child for example, can stand upright within the interior space and walk or run within the annular interior surface.

In one embodiment the barrel 16 is made in the shape of a double base spherical segment. In this embodiment the width of the barrel "W" (See FIG. 15) is substantially equal to the exterior periphery or diameter "D" of the shell 10 discussed above. Rims 12 are formed at both sides of the barrel deforming an operational recess 15. In the tilted position (see FIG. 7) the operational recess 15 engages the vertical walls of the pool to limit movement of the barrel 16 within the pool 20.

In FIG. 6, the rotational axis of the barrel-type vessel is substantially parallel to the surface of water. In this condition, upon movement of the operator, when a counter-clockwise force applied to the vessel, the vessel is rotated over the surface of the body of water in the opposite direction. This occurs in view of the friction at the interface between the vessel and the body of water. If the rotational axis of the vessel is moved to an angle to the surface of the body of water (see FIG. 7), the movements acting on the system should cause the device to turn.

Otherwise operation of the barrel shaped vessel 16 is analogous to the operation of the shell 10. However, an advantage of this embodiment is that the operator or child 22 can run in the upright position, creep, etc. inside the vessel, in a manner similar to a hamster wheel.

Figure 8:
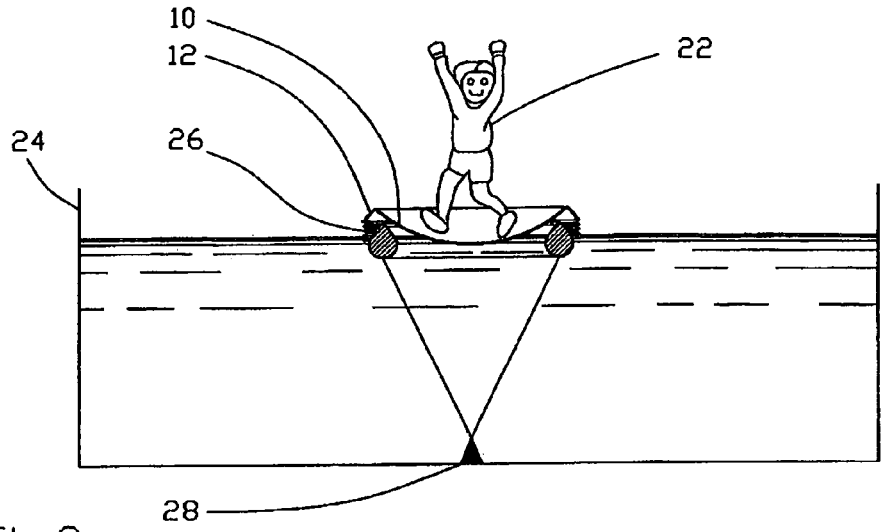
FIG. 8 is a view showing another embodiment of the invention.
Figure 9:
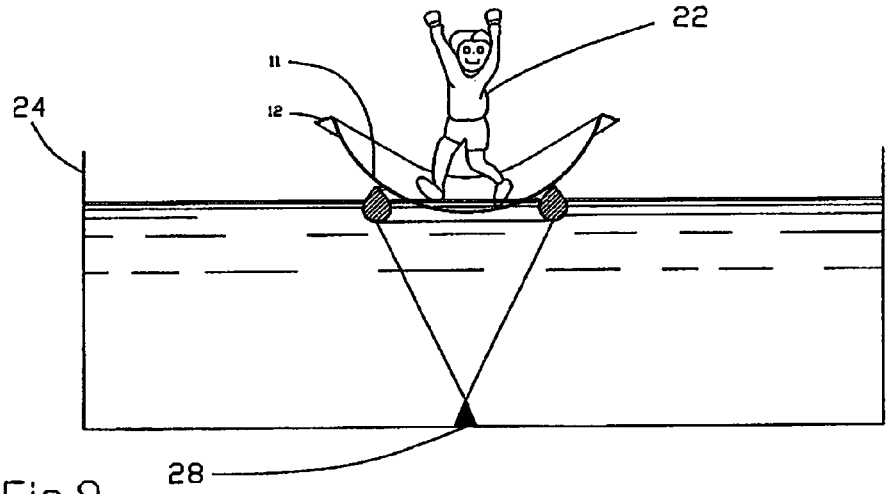
FIG. 9 is a view showing a further embodiment of the invention.
Figure 10:
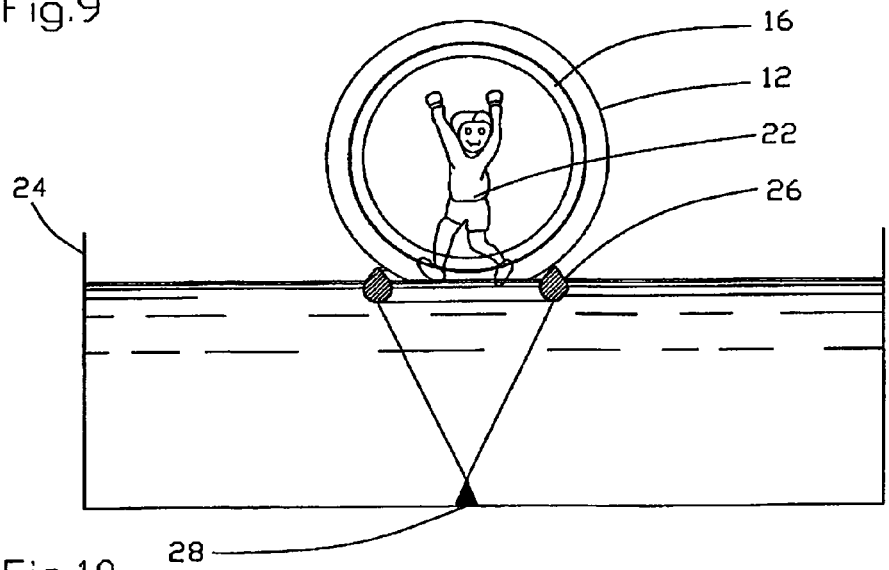
FIG. 10 is a view showing still another embodiment of the invention.

Referring now to a further embodiment of the invention illustrated in FIGS. 8-10, showing a substantially circular float 26 being placed in a fairly large body of water, such as in the swimming pool 24, for example. The float 26 has greater buoyancy than the combined weight of the respective vessels 10, 11 or 16 and the weight of the operator 22. An anchor 28 is provided, so as to limit motion of the float 26, the vessel 10, 11 or 16 and the operator 22 to a specific location within the pool 24.

In the embodiment of FIG. 8, the float 26 is used to support the shell 10 of the previously discussed embodiment of FIGS. 1 and 2. As to the embodiment of FIG. 9, the float 26 is adapted for use with the shell 11 previously discussed with respect to FIGS. 3-5. FIG. 10 illustrates the use of the float 26 in combination with the barrel-type vessel 16 similar to that discussed with respect to the embodiment of FIGS. 6 and 7.

The functionality of the float 26 is substantially similar to the previously described round pool 20. Operation of the barrel 16 and the shell 10 and shell 11 are analogous to that described above. The anchor 28 limits movement of the float 26 within the pool 24, so as to prevent collision of the operator supported by the respective vessel with people there.

Figure 11:
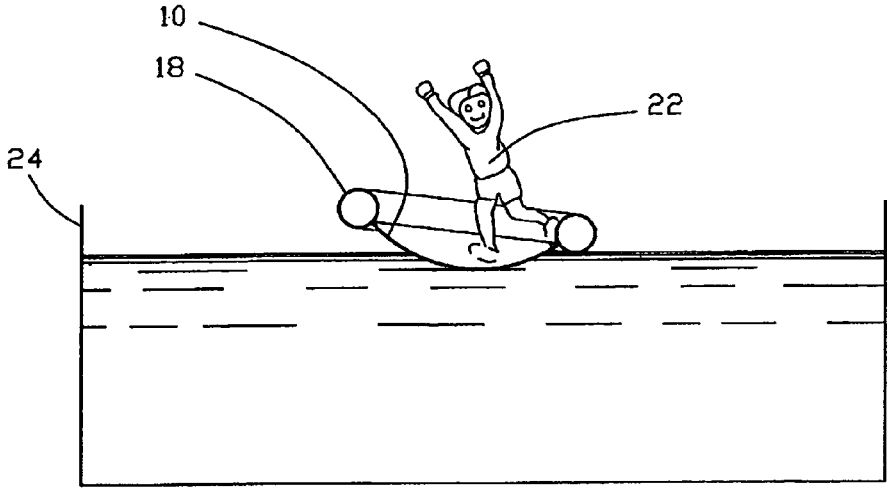
FIG. 11 is a view showing a modified embodiment of the invention.
Figure 12:
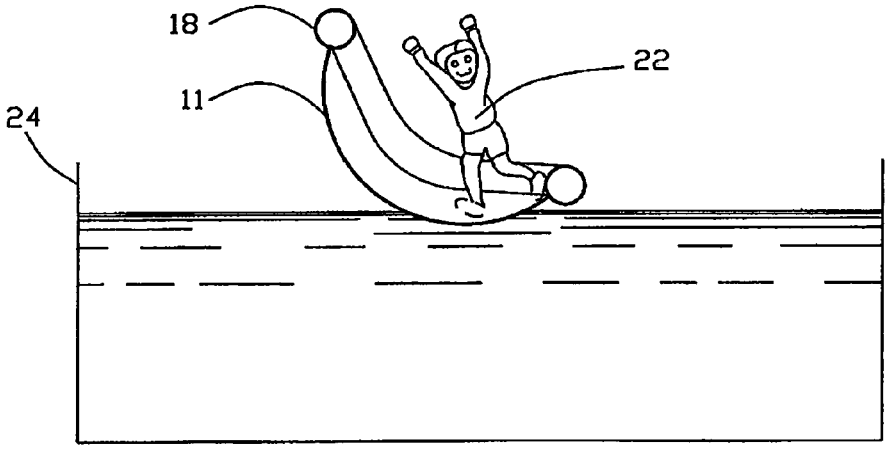
FIG. 12 is a view showing another modified embodiment of the invention.
Figure 13:
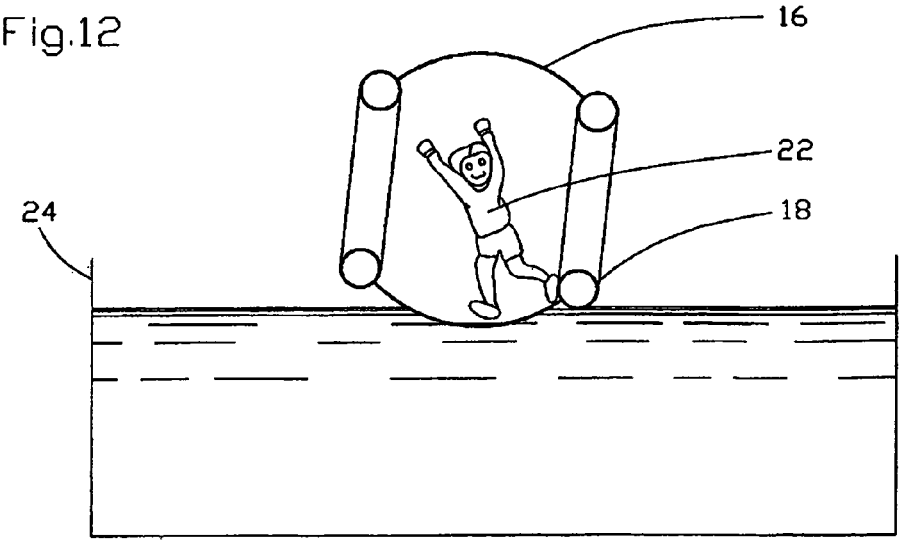
FIG. 13 is a view showing a further modified embodiment of the invention.

In the embodiments of FIGS. 11-13, a stabilizing arrangement 18 is provided to limit a tilting angle of the flotation device when it is used on open water or in a swimming pool of any size. Such arrangement can be in the form of a doughnut-shaped ring 18 provided at the outer periphery of the respective vessel. In the preferred embodiment, the stabilizer ring 18 is hollow and may be inflated.

FIG. 11 illustrates application of the doughnut-shaped stabilizing arrangement 18 connected to the floating circular shell 10 previously discussed with respect to FIGS. 1 and 2. The stabilizing arrangement 18 is attached at the outer peripheral edge of the shell. According to FIG. 12, the stabilizing arrangement 18 is connected to the elliptical shell 11 at the top peripheral surface thereof, as previously discussed with respect to FIGS. 3, 4 and 5. FIG. 13 illustrates application of the stabilizing arrangement 18 to the barrel-shaped vessel 16, as previously discuss with respect to FIGS. 6 and 7. In one application the doughnut-shaped rings can be attached to each rim 12. On the other hand, the rims 12 can be eliminated and the doughnut-shaped ring can be attached directly to the body of vessel at the respective side surfaces thereof.

It is understood however, that it is within the scope of the invention to provide the stabilizer rings 18 filled with any conventional buoyant material, for example, foamed rubber or plastic material, can be used for this purpose, the only requirements being that the device be stable and buoyant in water.

While it is contemplated that the device will be energized by the walking or running motion of the operator, it is also within the scope of the invention to utilize other conventional arrangements such as an electric motor, gasoline engine, etc. to cause or supplement motion of the device over the surface of a body of water.

Figure 14:
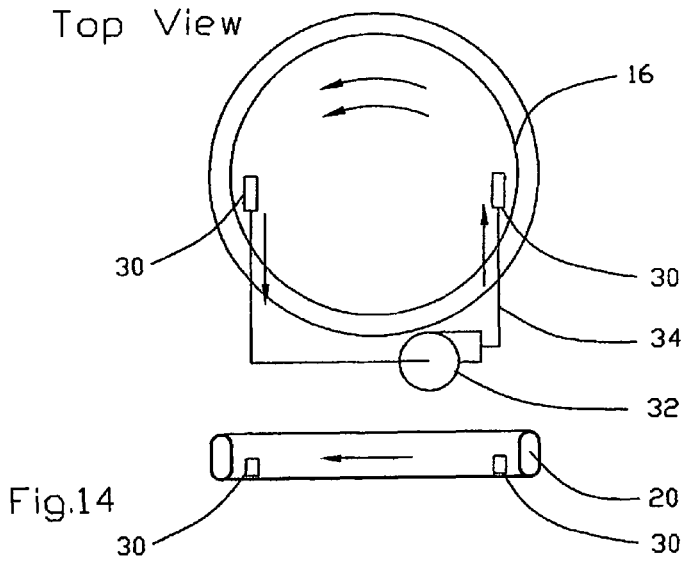
FIG. 14 is a top view showing an assembly according to still another modified embodiment of the invention.

Referring now to FIG. 14 illustrating a further embodiment of the invention and showing a pumping device 32 associated with a pool or water basin 20. A water pump 32 is connected by means of pipes or any other fitting arrangements 34 to two jets 30 positioned within the inner area of the pool or basin 36. In operation, upon energizing the pump arrangement 32, the jets 30 generate water streams directed along an inner surface of the pool 36. As illustrated in FIG. 14 the jets 30 produce circular motion of water within the pool illustrated by the arrows. In this manner, upon positioning of the recreational device within the water of the basin, its motion can be solely based or supplemented by the water streams generated by the jets 30, so as to carry the recreational device with the operator therealong. In actuality, in order to produce a circular motion of water within the basin, the jets 30 can be connected to any source of pressurized water. For example, the jets 30 can be connected to a source of running water by means of garden hose.

The universal of technical solutions, described above, show a wide field of using the device for recreational as well as commercial purposes. The device can be used also in any pond, lake, pool, etc.

Since a typical operator of the device of the invention is a child, the geometric configuration of the device is determined by the child's weight. For example, for a child having weight of about 50 lbs (22 kg) the following dimensions are recommended: the round pool diameter is about 36.0" (900.0 mm); the shell (or the barrel) curvature radius is about 30.0" (750.0 mm); the shell diameter (or the barrel width) is about 40.0" (1000.0 mm); the shell (or the barrel) tilt angel is approximately 20 degrees.

The internal diameter of the pool can be between that of the diameter of the submerged portion of the vessel (minimum diameter) and the rim diameter (maximum diameter). When the pool diameter is minimal it is possible to reach larger limits of the tilting angle of the shell (or the barrel), i.e. when the rim will set down on the edge of the pool. When the maximum diameter of the pool is provided, it is possible to reach a greater depth of the shells (or the barrel), i.e. on the same device that a child of greater weight can play.

The circular shell can be provided with an optional barrier/soft rail and net. This arrangement can act as a safety wall, so that infants can be positioned and play in the shell without supervision.

The device of the invention may consist of one peace of rigid forming material. In the alternative it can be made of rigid sections of the material that are jointed together and are sealed by an elastic cover. This sectional design makes it possible to reduce shipping dimensions.

The invention claimed is:

1. A recreational floatation device adapted to be propelled on a surface of water by movement of an operator situated within the device, wherein a center of gravity of the operator is located at a low area of his stomach, said device comprising:

a buoyant vessel having a partially-spherical exterior surface and sufficient internal area adapted to accommodate the operator, a rim extending along an outer periphery of the vessel, a deformable bellowed structure extending outwardly from the rim, so that the partially-spherical exterior surface of the shell, the rim and the bellowed structure form an operational recess therebetween, said buoyant vessel being configured so as to have a metacenter thereof being spaced from and located above the center of gravity of the operator, wherein stability of a vessel-operator system is determined by stability of a distance between the metacenter and the center of gravity of the operator.

2. The device according to claim 1, wherein said buoyant vessel is an open-end body in the form of a circular shell with the exterior surface being formed as a segment of a sphere, said rim is a substantially circular rim.

3. The device according to claim 1, wherein said device is adapted for flotation in a water situated within a pool formed by at least vertical side walls thereof, so that in a tilted position of the shell the operational recess is adapted for close engagement with the side wall of the pool to prevent interference of a body of the operator with inner portions of the device.

4. The device according to claim 3, wherein the pool is in a form of a substantially circular float placed on the surface of open water.

5. The device according to claim 1, wherein said buoyant vessel is an open-end body in the form of an elliptical shell formed by cutting a spherical body along an elliptical line traced on the partially-spherical exterior surface.

6. The device according to claim 5, wherein said elliptical shell is formed with an elliptical rim at an exterior periphery of the shell.

7. The device according claim 1, wherein said buoyant vessel is formed having a barrel-type configuration with an internal area thereof adapted to accommodate the operator in an upright position.

8. The device according to claim 7, wherein said barrel-type vessel is formed with rims provided at each side thereof.

9. The device according to claim 1, further comprising a stabilizing arrangement for limiting a tilting angel of the device on the surface of water.

10. The device according to claim 9, wherein said stabilizing arrangement is in the form of a doughnut-shaped ring.

11. The device according to claim 10, wherein said doughnut-shaped ring has a hollow inflatable interior.

12. The device according to claim 9, wherein the doughnut-shaped ring is made of a semi-solid buoyant material.

13. The device according to claim 1, wherein the motion of the flotation device over the surface of water is supplemented by an energizing arrangement.

14. The device according to claim 13, wherein said energizing arrangement is at least partially situated within a pool, said arrangement is in a form of a least one jet generating a stream of water.

15. A recreational floatation device adapted to be propelled on a surface of water contained in a pool by movement of an operator situated within the device, wherein a center of gravity of the operator is located at a low area of his stomach, said device comprising:

a buoyant vessel having an exterior surface with a concave rim extending along an outer periphery of the vessel and a sufficient internal area adapted to accommodate the operator, a deformable bellowed structure extending outwardly from the rim, so that the exterior surface of the vessel, the rim and the bellowed structure form an operational recess therebetween, said buoyant vessel being configured so as to have a metacenter thereof being spaced from and located above the center of gravity of the operator, stability of a vessel-operator system is determined by stability of a distance between the metacenter and the center of the gravity of the operator, walls forming an inner periphery of the pool, said walls closely corresponding to the exterior surface of the buoyant vessel, a top portion of the walls of the pool having a convex configuration adapted for close cooperation with the concave rim of the vessel, so as to prevent excessive tilting of the vessel by the movement of the operator situated within the device.

16. The device according to claim 15, wherein in a tilted position of the vessel the operational recess is adapted for close engagement with the walls of the pool to prevent interference of a body of the operator with inner portions of the device.

17. The device according to claim 15, wherein said buoyant vessel has an open-end body in the form of an elliptical shell formed by cutting a spherical body along an elliptical line traced on the spherical surface.

18. The device according to claim 15, wherein motion of the flotation device over the water is supplemented by an energizing arrangement.

* * * * *